US005275098A

United States Patent [19]

Larson

[11] Patent Number: 5,275,098

[45] Date of Patent: Jan. 4, 1994

[54] PORTABLE SCREEN PRINTING DEVICE

[76] Inventor: James D. Larson, 6323-83rd Ave. SE., Snohomish, Wash. 98290

[21] Appl. No.: 6,711

[22] Filed: Jan. 21, 1993

Related U.S. Application Data

[63] Continuation of Ser. No. 799,739, Nov. 22, 1991, abandoned, which is a continuation-in-part of Ser. No. 492,720, Mar. 13, 1990, abandoned.

[51] Int. Cl.[5] ..... B41L 19/92; B41F 15/36

[52] U.S. Cl. ..... 101/123; 101/114; 118/406

[58] Field of Search ..... 101/114, 115, 123, 124, 101/126; 118/406, 213

[56] References Cited

U.S. PATENT DOCUMENTS

| | | | |
|---|---|---|---|
| 3,263,603 | 8/1966 | Fuchs | 101/123 |
| 3,828,671 | 8/1974 | Fuchs | 101/123 |
| 3,857,337 | 12/1974 | Tsuji et al. | 101/123 |
| 3,859,917 | 1/1975 | Burley et al. | 101/123 |
| 3,955,501 | 5/1976 | Bubley et al. | 101/123 |
| 4,493,254 | 1/1985 | Landesman et al. | 101/123 |
| 4,949,636 | 8/1990 | Tachibana | 101/123 |

FOREIGN PATENT DOCUMENTS

| | | | |
|---|---|---|---|
| 0132643 | 6/1987 | Japan | 101/123 |
| 0293057 | 11/1988 | Japan | 101/123 |

OTHER PUBLICATIONS

The Satellite Brochure "The Automatic Round Screen Printing Machine" Jan. 4, 1990.

*Primary Examiner*—Edgar S. Burr
*Assistant Examiner*—Christopher A. Bennett
*Attorney, Agent, or Firm*—Jensen & Puntigam

[57] ABSTRACT

A portable automatic silk screen printer including a frame (24) supporting a transport device (26) which selectively moves a printing head (28) which is programmed to control the flood and squeegee bars (56, 58).

5 Claims, 6 Drawing Sheets

FIG. 1
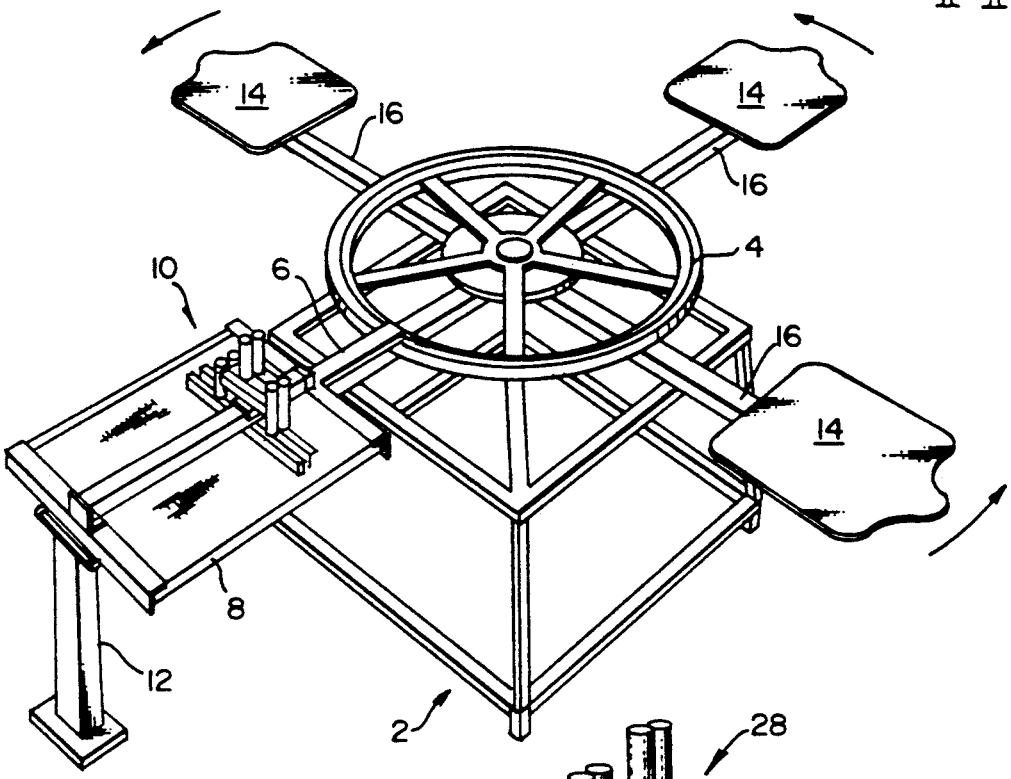
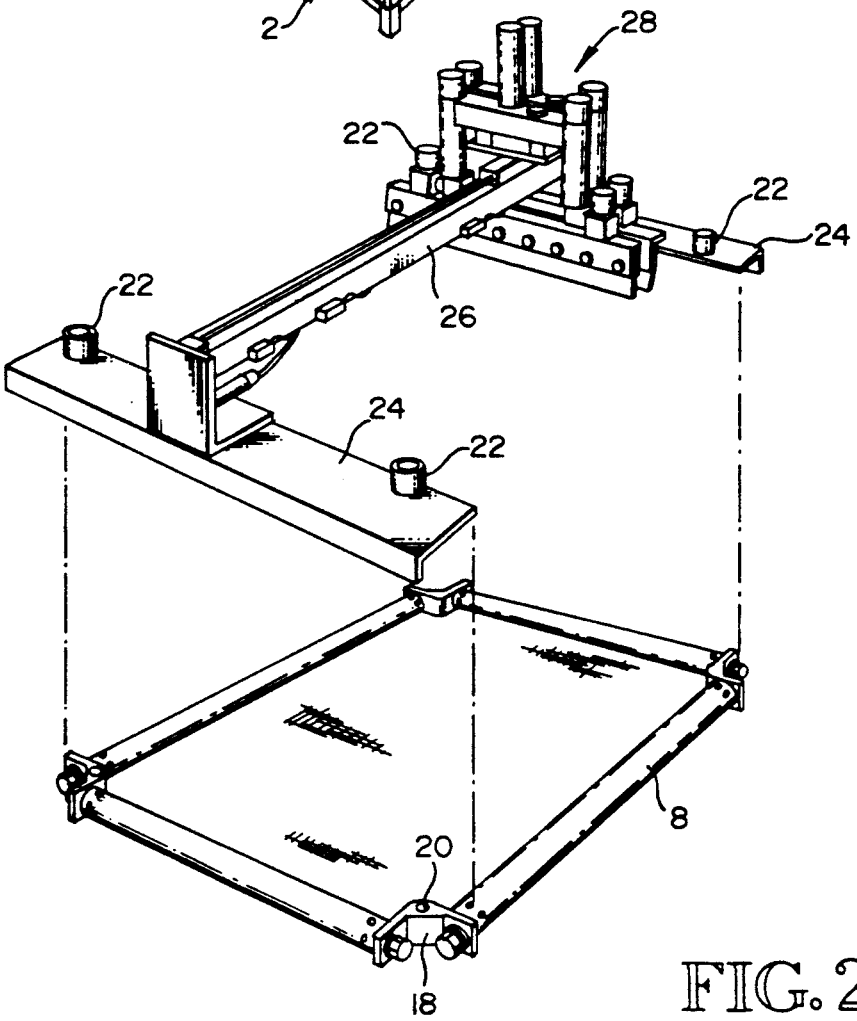
FIG. 2

FIG. 3
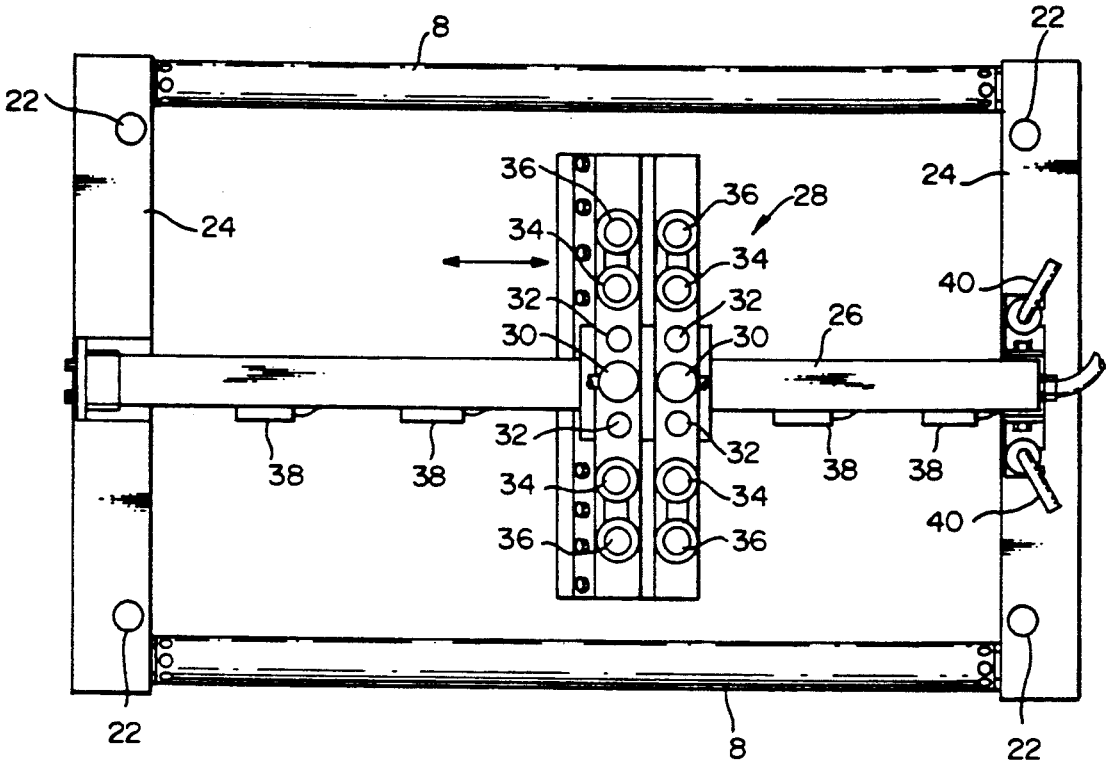
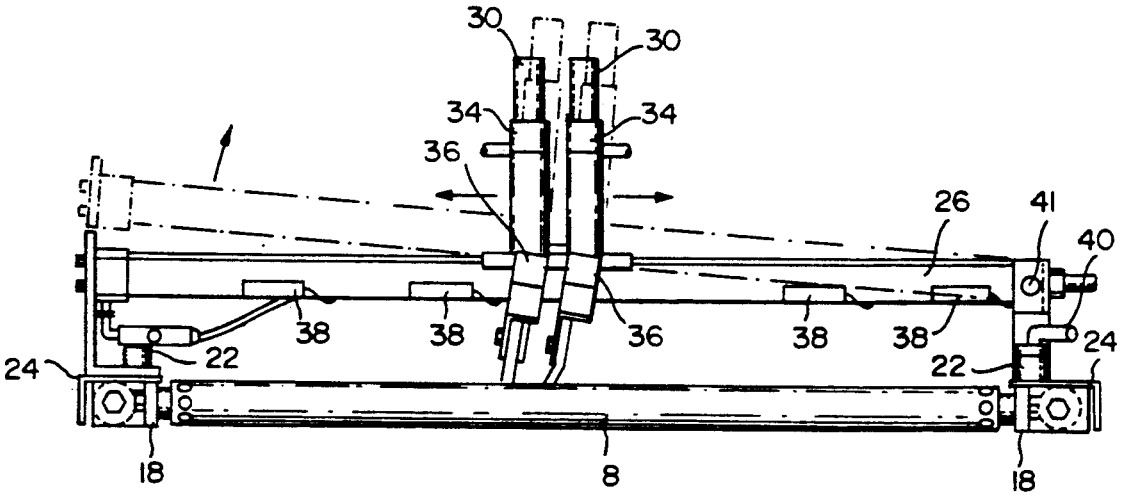
FIG. 4

PORTABLE SCREEN PRINTING DEVICE

This is a continuation of application Ser. No. 07/799,739 filed on Nov. 22, 1991 now abandoned, which was a continuation-in-part of application Ser. No. 07/992,720 filed on Mar. 13, 1990 now abandoned.

TECHNICAL FIELD

This invention relates to silk screening and more particularly to a lightweight portable device which may be quickly and easily attached to or used with any one of a number of frames or surfaces and will automatically and consistently, including generating a consistent pressure, move the flood bar and the squeegee over the screen, resulting in a consistent, high-quality print.

BACKGROUND ART

At the current time, silk screening is being accomplished by two primary methods: the first being the manual method wherein the screen is stretched and the ink is applied by an individual person flooding the screen and then squeegeeing the screen. As is obvious, to get a consistent quality product with the manual method, the individual doing the screening must be skilled and must not allow the speed of his strokes, pressure upon the screen or the angle of his tool to vary because of fatigue and/or distractions.

The second primary method of silk screening is found in high volume silk screen shops which employ automatic silk screening devices which cost anywhere from $30,000 on up. The cost makes these devices prohibitive for many operations. It is to be understood that not only are the automatic silk screening devices expensive, but they are also large and heavy, rendering them a permanently installed device.

Prior art devices known to the present inventor include:

U.S. Pat. No. 3,486,441 granted to Hillman et al, Dec. 30, 1969, discloses a universal table including a compound adjustment means for positioning the device to be screened beneath the screen.

U.S Pat. No. 3,955,501 granted to Bubley et al, on May 11, 1976, discloses a screen printing press and is particularly directed to an actuator for the squeegee and flood bar.

U.S. Pat. No. 4,038,920 granted to Crowley et al, Aug. 2, 1977 discloses an apparatus for controlling the position of the squeegee by means of a cam and cam-follower mechanism.

U.S. Pat. No. 4,063,503 granted Ishinose, Dec. 20, 1977, discloses an automatic screen printing machine, and in particular, discloses a device wherein an automatic flat screen printing machine, the relative vertical movement of the stencil, and the position of the material to be printed is performed in the proper sequence by mounting the squeegee and doctor blade on a common support driven by a mutual pinion.

U.S. Pat. No. 4,084,505 granted to Ishinose, Dec. 18, 1978, discloses a means for adjusting the phase of a flat screen in an automatic screen printing machine.

U.S. Pat. No. 4,094,242 granted to Ishinose, on Jun. 14, 1978, discloses a screen printing machine wherein a lifting device causes the material to be printed to be moved into contact with the screen during the printing step and lowers and separates the material during non-printing periods.

U.S. Pat. No. 4,103,613 granted to Mitter, Aug. 1, 1978, discloses a screen printing machine including one or more stations wherein each station is capable of multi-color printing.

U.S. Pat. No. 4,109,593 granted to Strauch et al, Aug. 29, 1978, discloses a device for silk screening upon cylindrical devices including a means for adjusting the machine to accommodate various diameters.

U.S. Pat. No. 4,117,799 granted Coaula et al, Oct. 3, 1978 discloses an automatic printing device wherein the blanks to be printed are automatically moved into and out of the printing station.

U.S. Pat. No. 4,248,150 granted to Lala, Feb. 3, 1981, discloses a linkage between the screen and the flood bar which controls the relative vertical position of the apparatus.

U.S. Pat. No. 4,413,550 granted to Bubley, Nov. 8, 1983, discloses a multi-screen drive for screen printing presses.

U.S. Pat. No. 4,485,736 granted to Strutz, Jr. et al, Dec. 4, 1984, discloses an ink dispensing system for use with a silk screen printing machine.

U.S. Pat. No. 4,493,254 granted to Landisman et al, Jan. 15, 1985, discloses a carousel-type rotatable screen printing machine.

U.S. Pat. No. 4,510,864 granted to Klemm, Apr. 16, 1985, discloses a screen printing machine including an internal cooling unit and includes a web supply roller located beneath the printing station.

U.S. Pat. No. 4,589,336 granted to Klemm, May 20, 1986, discloses a screen printing machine having a reciprocal printing screen and a counter-pressure roller.

U.S. Pat. No. 4,628,814 granted to Klemm on Dec. 16, 1986, discloses a machine having reciprocable screens and which allows more ready access to the screen.

U.S. Pat. No. 4,817,524 granted to Reimer on Apr. 4, 1989, discloses an apparatus wherein the ink pressure is held constant by varying the squeegee speed and/or squeegee angle.

DISCLOSURE OF THE INVENTION

With the above-noted prior art and problems in mind, it is an object of the present invention to provide a screen printing device that converts a manually-operated silk screen installation into a semi-automatic or automatic machine increasing the productivity and assuring a consistent quality.

It is another object of the present invention to provide a lightweight portable automatic silk screening device which is capable of being locked to any one of a variety of individual frames.

It is still another object of the present invention to provide a silk screening which is completely transferable to any manually operated printing system.

Yet another object of the present invention is to provide a silk screening device which allows printing on any flat surface.

Yet a further object of the present invention is to provide an automatic portable lightweight silk screening device which is capable of accurately screening objects of various sizes since the stroke is infinitely adjustable within the limits of the controlling piston.

DESCRIPTION OF THE DRAWINGS

FIG. 1 is a pictorial representation of a multi-station silk screen machine utilizing the present invention at one station.

FIG. 2 is an exploded view of the present invention and the silk screen frame to which it would normally be attached.

FIG. 3 is a top-plan view of the of the present invention as attached to a silk screen frame.

FIG. 4 is a side elevation view of the present invention attached to a silk screen frame illustrating the fact that the printing device may be pivoted about its rear attachment to facilitate cleaning and the like.

BEST MODE FOR CARRYING OUT THE INVENTION

Figure 5:
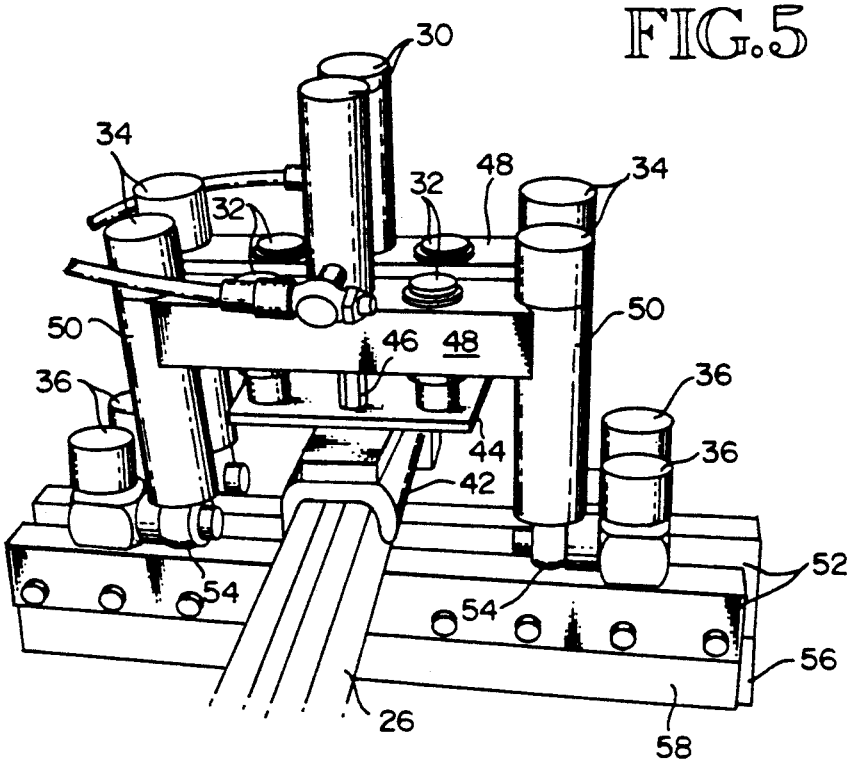
FIG. 5 is an enlarged isometric view of the printing head.

As seen in FIG. 1, the present invention is adapted for use in an automated silk screen machine which includes a basic support frame 2 having a fixed stand 4 including at least one outwardly projecting arm 6, upon which the silk screen frame 8 and the silk screen printing device 10 are mounted.

For illustrative purposes, a rigid stand 12 is shown supporting the outer edge of the silk screen frame and printing device. A plurality of support platforms 14 mounted upon arms 16 are sequentially moved from station to station, it being understood that each station could be a different color, there could be a load/unload station, the time during movement from station to station could be used for insuring that the ink is dried, or the like. The invention could equally well be used in a multi-station straight link installation or in a single station installation.

In a multi-station installation, it is contemplated that the entire frame, including the printer, would be elevated to facilitate moving the work piece from station to station. This movement could well be accomplished by a spring-extended air cylinder or the like secured to a fixed object with the rod pivotably secured to the frame.

As seen in FIG. 2, the silk screen frame 8 includes inter-connecting corners 18 having threaded vertical holes 20 for receiving threaded fastening members 22 which extend through the ends of frame members 24 of the inventive printing device. Extending between frame members 24 and secured thereto, is a band cylinder 26 which carries and moves the printing head 28, and attached tools which will be described in greater detail hereinafter.

Reference is now had to FIG. 3 which is a top-plan view of the silk screen printer, in position, secured to the frame of a silk screen stretching device. As seen in this view, the printing head 28 is selectively moved along the beam 26, and as explained hereinafter, will either flood or print, depending upon which tool is in contact with the screen. Further to be seen in this view, are a pair of vertically disposed cylinders 30 which, as will be explained hereinafter, control the vertical position of the tool attached thereto, four guiderods 32 to assure that the movement of the tool into and out of contact with the screen is truly vertical, four major adjustment knobs 34, and four minor adjustment knobs 36.

Likewise seen in this view are a series of reed switches 38, which signal a control computer (not shown) as to the location of the piston within the band cylinder such that the controlling computer can selectively activate cylinders 30 to properly position the appropriate tool with respect to the screen and the position within the cycle.

A pair of quick-release handles 40 secure the beam 26 and its printing mechanism to the frame 24.

Reference is now had to FIG. 4 which is a side elevation view of the device as shown in FIG. 3 and as seen in this view, the transporter in the form of a beam is pivotable about 40 allowing the device to be elevated from the screen for cleaning or other maintenance purposes.

Referring to FIG. 5, it can be seen that the carrier 42, which is moved linearly along the length of beam 26 by a piston (not shown), has secured to the upper portion thereof a plate 44 upon which are mounted four vertical stabilizing posts 32 and a pair of vertically mounted cylinders 30. The piston rods 46 of cylinders 30 interact with the plate 44 causing the parallel yoke members 48 to move vertically relative to the silk screen (not shown in this view). The major adjustment knobs 34 are threaded into cylinders 50 and vertically adjust flood and squeegee securement elements 52 via the knuckle element 54 which allows the micro adjusting knobs 36 to further adjust the positions of the support members 52.

It is to be understood that each of the parallel support bars is individually adjustable by both the major adjustment elements 34 and the minor adjustment elements 36. The combination of these adjustments assure that the most efficient and appropriate contact is made between the flood bar 56 and/or the squeegee bar 58.

Figure 6:
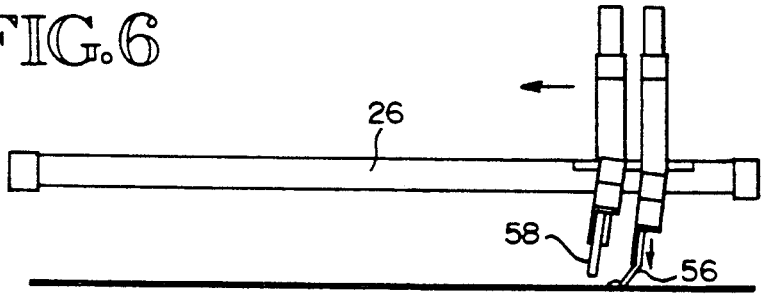
FIG. 6 is a schematic view illustrating the device during the flooding operation.
Figure 7:
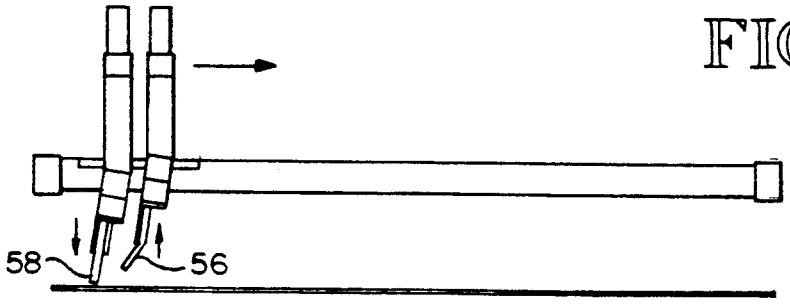
FIG. 7 is a schematic view showing the inventive apparatus during the squeegee or printing operation.

FIGS. 6 and 7 indicate the relative positions of the flood and squeegee elements during flooding 6 and squeegeeing 7. The interaction of the reed switches 38 and the controlling computer are such that the flood and squeegee are raised and lowered selectively to assure that the entire screen is contacted by the appropriate instrument during the proper stage of the operation.

Thus, as can be seen, the present invention contemplates a relatively lightweight inexpensive method which allows the automation of any silk screen process.

Figure 8:
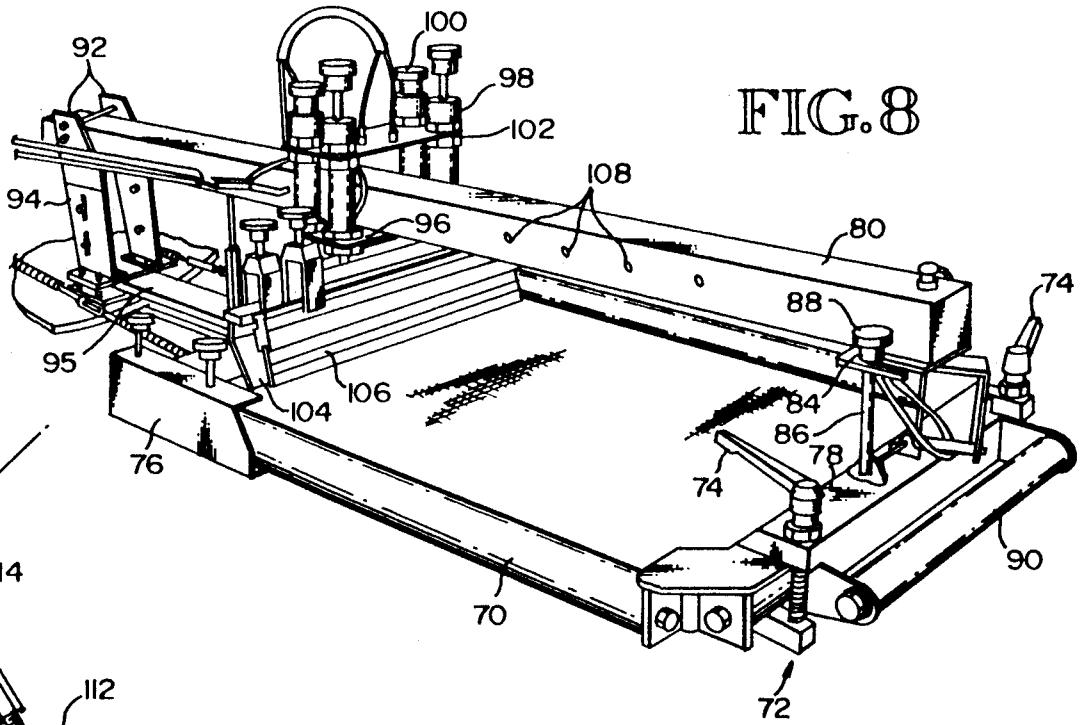
FIG. 8 is an isometric view of another embodiment of the present invention.

The embodiment as depicted in FIG. 8 is adjustable as was seen in the previous embodiment so that it may be adapted readily and easily to frames of a different size by simply adjusting the frame attachment to fit the frame. The printer is readily attached to existing single-station or multi-station machines through the application of standard fastening means. The device includes adjustments such that the sweep of the squeegee and flood bar consistently maintain a constant pressure upon the screen during the screening process.

As seen in FIG. 8, silk screen frame 70 is secured to the inventive apparatus by means of clamping mechanism 72 at its forward end, including a handle member 74 for tightening at the front of the frame and by clamping means 76 at the rear of the screen. As has been stated hereinabove, both the clamping members 72 and 76 are adjustable in width to accommodate screens of different width and obviously since 72 and its supporting frame mechanism 78 are not connected literally to clamping element 76, the device can be adjusted to accommodate frame members of a different length.

The apparatus which permits versatility and consistency comprises a rigid, hollow rectangular structural beam 80 which, as described hereinafter, serves as both the transport means for the silk screen apparatus and also as a structural member assuring that the screening process maintains a constant pressure throughout the stroke. The beam 80 extends from the front of the machine whereat plate 82 is secured, said plate has a pair of forwardly open slots 84 to receive pivotally mounted threaded members 86 having mating cap members 88. The members 86 and caps 88 adjustably secure the forward end of the beam 80 to the rigid frame member 78 which serves as the upper portion of clamping element 72 described hereinafter. It is to be noted also that a handle member 90 is rigidly secured to the frame member 78 to permit the easy raising and lowering of the apparatus to permit replacement of the garment to be screened.

Structural beam 80 extends rearwardly to terminate in a securement device which comprises a pair of downwardly projecting ears 92 which are rigidly secured to the beam 80 and are adjustably secured to a pair of upwardly extending ears 94 which are a part of the multi-station machine provided. It is to be understood that the various manufacturers of screening apparatus or turntables would have a variety of means of securing the actual silk screening device to their turntable on a multi-station device or to their rigid framework on a single-station device and, although having the securement means be adjustable is critical, the fastening itself is a matter of mechanical choice.

Also seen in this view is the squeegee and flood bar transport mechanism which includes a plate 96 which as explained hereinafter is bolted directly to the transport means mounted without structural element 80. Secured to plate 96 and extending therethrough are two pair of pneumatic cylinders 98 and 100, one pair for the squeegee and one pair for the flood bar. These cylinders extend upwardly above the structural element 80 and are secured together above the element 80 by a plate 102 such that the cylinders are vertically stable. Suspended beneath the cylinders 98 and 100 and controlled thereby in terms of vertical position are the squeegee and flood bars 104 and 106. It is to be understood that the squeegee and flood bars 104 and 106 are adjustable in terms of the relative angle at which they attach the screen supported by frame 70 and also to assure that they are parallel to the screen adjustable fore and aft as well as laterally.

It is to be noted that there are a plurality of horizontal bores 108 in member 80 permitting a rigid rod to be placed therethrough, restricting the travel of the transport means along member 80. The transport means controls the screening mechanism generally depicted by the numerals 96–106.

Figure 10:
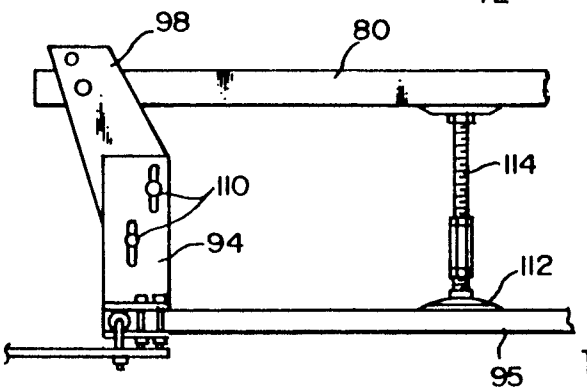
FIG. 10 is a elevational view through that portion depicted in FIG. 9.
Figure 9:
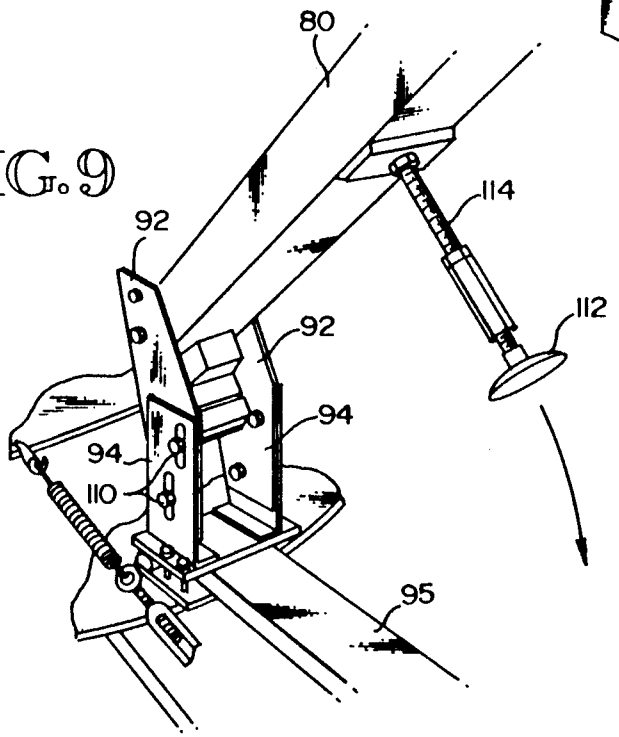
FIG. 9 is an enlarged view depicting the attachment of the present invention to a multi-station silk screening device including the stabilizing adjustment.

Reference is now had to FIGS. 9 and 10 wherein the rear portion of structural member 80 may be seen, it is pivotably secured to ears 92 which are in turn secured to ears 94 rigidly secured to fixed arm 95 by means of bolts 110. Bolts 110 are mounted in slots in ears 94 allowing vertical adjustment of the rear end of the rigid member 80. A downwardly extending foot 112 secured to the underside of 80 and including a threaded adjustment 114 assures that there is solid contact between 80 and the lower supporting bar 95, further stabilizing the entire mechanism.

It can readily be seen that the combination of the adjustments possible through elements 94, 110, 112, 114, 84, 86, 88 allows that the horizontal structural member 80 can be adjusted so that it is perfectly parallel to the screen enabling a consistent and predictable sweep of the flood and squeegee.

Figure 11:
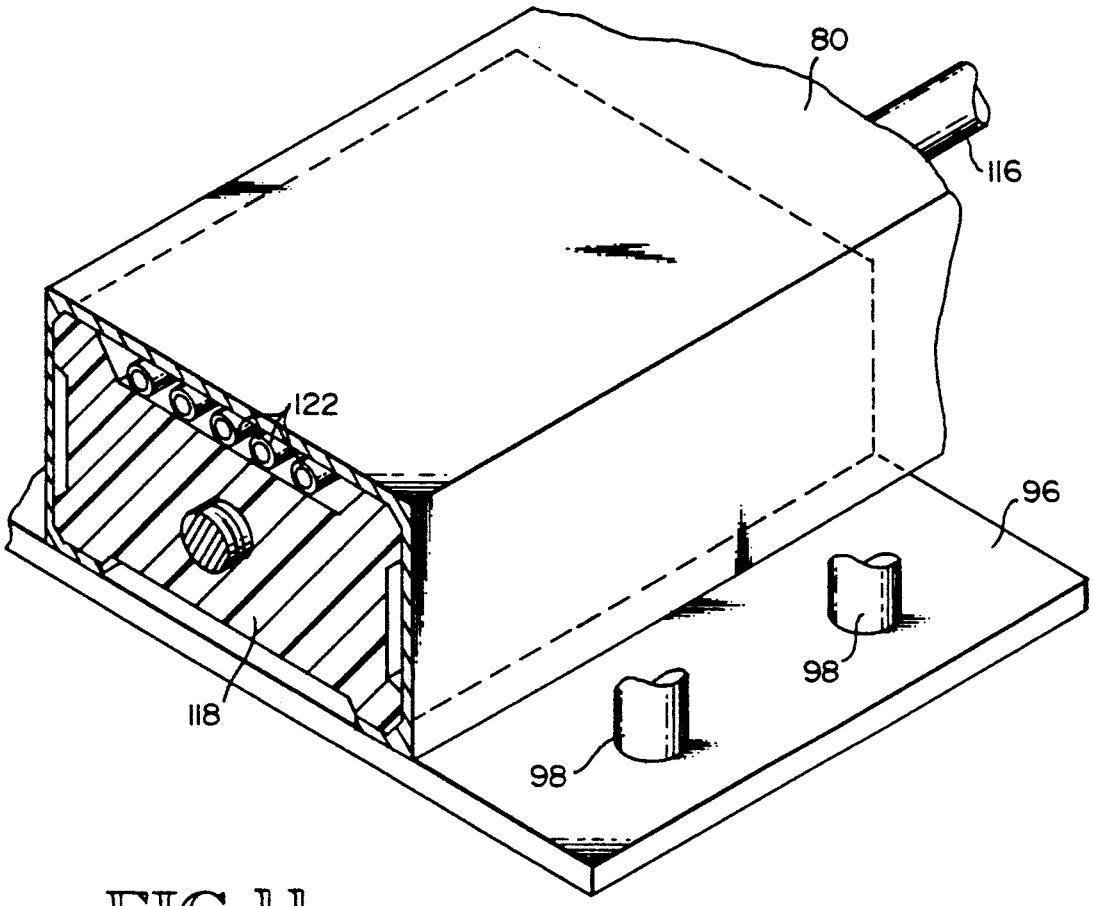
FIG. 11 is an enlarged sectional view showing the transport mechanism.

Reference is now had to FIG. 11 wherein the section through the hollow structural member 80 discloses that in the interior of the member is a standard pneumatic cylinder having a rod 116. The block 118 may be made of any material that is relatively frictionless with respect to the interior of the structural member 80. It is to be noted that block 118 has a reduced dimension in its central portions, both vertically and horizontally, leaving four corner sections 120 which provide lateral stability as it moves within the interior of member 80. It is to be noted that the reduced upper portion serves as a receptacle/carrier for a plurality of pneumatic conduits 122 for controlling the position of the squeegee and flood bar, thus permitting these connections to be located within the member 80.

Figure 12:
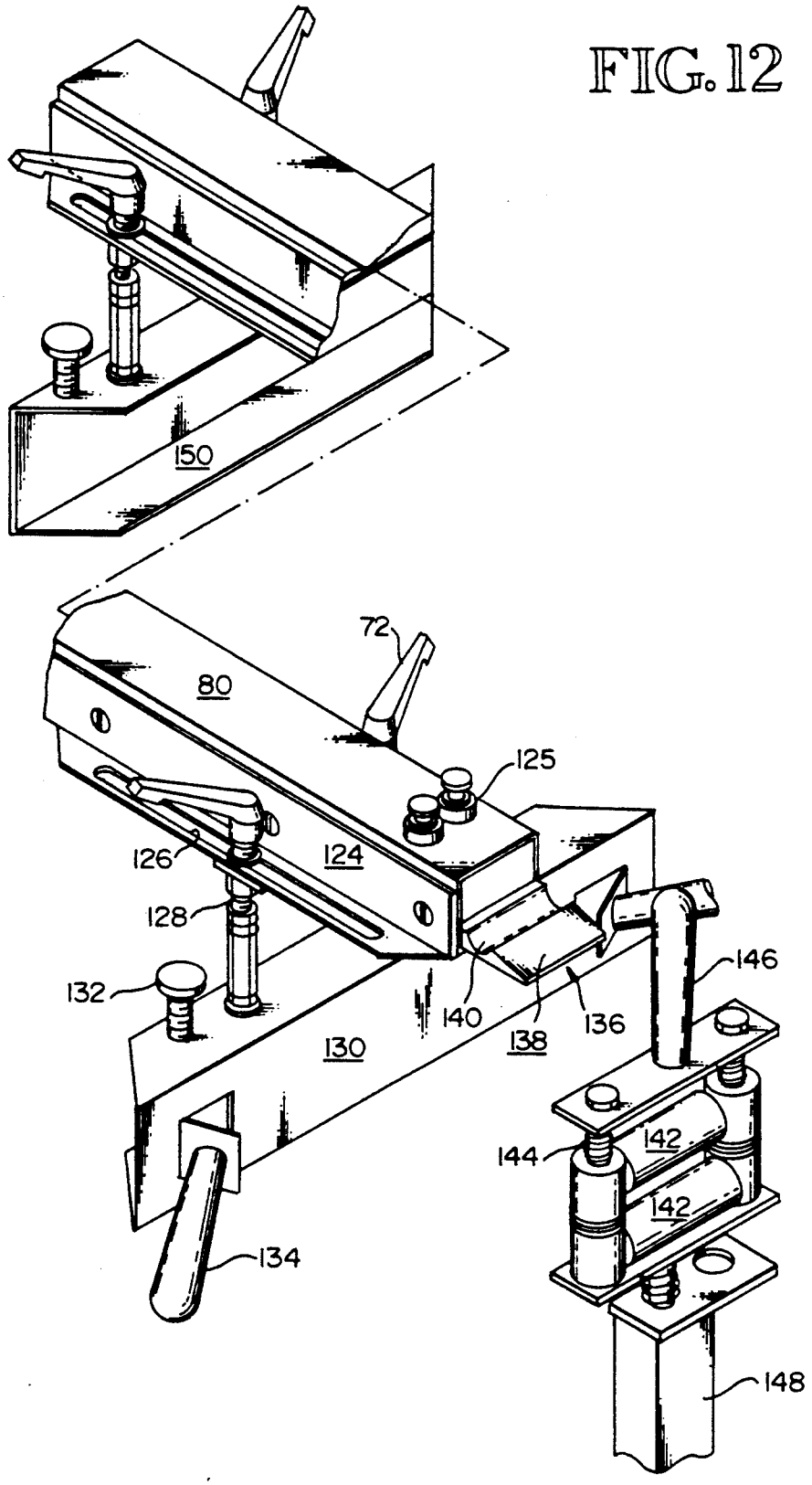
FIG. 12 is an isometric view of yet another embodiment of the present invention including a floor stand.

Reference is now had to FIG. 12 wherein another modification of the present device is shown. As seen in this view, the horizontal structural member 80 includes a piece of angle iron 124 secured to each side thereof, having a slot 126 cut into the horizontal portion thereof to receive a threaded shaft 128 which is secured to a horizontal C-channel 130. Handle 74 secures the shaft 128 along the slot 126, thereby allowing the device to adapt to frames of a different size. A tightening member 132 is provided in the upper horizontal member of the C-channel 130 and a pair of handles 134 are secured to the outer face of said channel.

Likewise seen in this view is a forwardly projecting tongue generally designated as 136 which includes an inclined forward portion 138 and a dished portion 140 generally parallel to the front of the structural member 80. Adapted to interact with the tongue 136 is a pneumatically controlled floor stand which includes a pair of horizontally disposed spring-loaded rollers 142 which interact with tongue 136, locking it in a predetermined vertical position between the rollers 142. It is to be noted that the spring 144 assures that the contact between 136 and 142 is constant. A handle 146 is provided such that the floor stand can be moved away from the tongue if desired to elevate the mechanism. A pneumatic cylinder within the vertically extending structural member 148 is controlled by a foot switch (not shown) such that the operator, upon activating the foot switch, causes the roller mechanism 142, 144 to move upwardly, carrying the tongue 136 and the structural member 80 therewith such that a garment may be moved into or out of a position beneath the screen captured by the forward frame member 130 and a rearward, oppositely facing frame member 150.

An optional frame member 150 is mounted to the rear of the structural member 80 in a manner similar to the mounting of frame member 130, such that both of these frame members may be adjusted to accommodate a silk screen stretching frame and likewise permits the entire mechanism to be used upon any flat surface if so desired.

I claim:

1. A portable lightweight press for use in silk screening comprising:

at least one pair of spaced support means for connection to a frame supporting the material to be screened at opposite ends of the material, the spaced support means locating the printer suitably close to the material, adjustable transport means removably attached to and extending between the support means and selectively movable there between, carriage means mounted to and transported on the transport means, said carriage means comprising a carrier movably coupled to the transport means, a pair of upper horizontal, substantially parallel bars having ends, vertical cylinder means connecting the carrier to the pair of upper horizontal, substantially parallel bars for controlling the vertical position of the bars relative to the transport means, guide means linking the transport means and the pair of upper horizontal, substantially parallel bars to assure vertical travel of the pair of upper horizontal, substantially parallel bars, a rigid vertical member extending downwardly from each end of each of the pair of upper horizontal, substantially parallel bars to a position beneath the transport means, a vertically adjustable knuckle member connected to each of said vertical members, at least one silk screen tool mounted perpendicular to the transport means, said tool being secured to a pair of said knuckle members whereby the tool may be adjusted to contact the material to be screened uniformly, and control means for sequentially moving the carrier and tool across the material to be screened assuring consistent prints.

2. A portable silk screen printing device adapted for use with a silk screen frame, said silk screen frame including a silk screen, said printing device comprising:

(a) a single beam having a pair of ends;

(b) frame attachment means for mounting on said silk screen frame, said frame attachment means being connected to said beam substantially at the ends of said beam, said beam and said frame attachment means collectively forming a generally I-shaped configuration;

(c) print head means mounted on said beam for nonrotational movement linearly along said beam, said print head means comprising:

(i) a pair of silk screen printing tools comprising a squeegee bar and a floor bar;

(ii) means for selectively, individually moving each of said tools between a position removed from said silk screen and a position in contact with said silk screen; and (iii) adjusting means for individually adjusting the orientation of each of said tools relative to said beam and thereby relative to said silk screen frame so that each of said tools is in said position in contact with said silk screen; and (d) means adapting said print head means to be connected to power means for linearly moving said print head means along said beam and for selectively moving each of said tools between said position removed from said silk screen and said position in contact with said silk screen.

3. The portable silk screen printing device of claim 2, wherein:

said beam has a noncircular cross-section;

carrier means for slidably, nonrotationally coupling said print head means with said noncircular cross-section of said beam;

said means for selectively moving each of said tools comprises: (1) yoke means mounted on said carrier means for reciprocal movement relative thereto, the direction of said reciprocal movement being generally orthogonal to said beam; (2) tool support means for connecting said yoke means to said silk screen tool; and (3) means for reciprocally moving said yoke means and thereby said tool support means relative to said carrier means; and said adjusting means comprises major and minor adjustment means interconnecting each of said yoke and each of said tool supports for making coarse and fine adjustments, respectively, of the spacing of each of said tools from said beam, said major and minor adjustment means each having adjusting elements positioned laterally outwardly from said beam on both sides of said beam for adjusting the longitudinal tilt of each of said tools and for adjusting the pressure of each of said tools on said silk screen when each of said tools is in contact with said silk screen.

4. The portable silk screen printing device of claim 3, wherein:

said beam comprises a hollow body having a longitudinal opening along at least a major portion of said beam;

said carrier means comprises a block slidably received in said hollow body;

said print head means being coupled to said carrier means through said longitudinal opening, said print head means further comprising stabilizing means for vertically guiding reciprocation of said yoke means, said stabilizing means being fixedly mounted to said carrier means; and said means for reciprocally moving said yoke means comprises piston means.

5. The portable silk screen printing device of claim 4, wherein said frame attachment support means includes means for adjusting the orientation of said frame attachment means relative to said beam, whereby frames of different sizes may be attached to said portable silk screen printing device.

* * * * *